US008057208B2

(12) United States Patent
Bambi et al.

(10) Patent No.: US 8,057,208 B2
(45) Date of Patent: Nov. 15, 2011

(54) INSTALLATION FOR THE MANUFACTURE OF CERAMIC PRODUCTS

(75) Inventors: Domenico Bambi, Budrio (IT); Enrico Quadalti, Borgo Tossignano (IT); Roberto Saponelli, Imola (IT)

(73) Assignee: Sacmi Cooperativa Meccanici Imola Societa' Cooperativa, Imola (IT)

( * ) Notice: Subject to any disclaimer, the term of this patent is extended or adjusted under 35 U.S.C. 154(b) by 334 days.

(21) Appl. No.: 12/403,818

(22) Filed: Mar. 13, 2009

(65) Prior Publication Data

US 2009/0230591 A1 Sep. 17, 2009

(30) Foreign Application Priority Data

Mar. 17, 2008 (IT) ..... BO2008A0173

(51) Int. Cl.
*B28B 17/00* (2006.01)
*B28B 1/26* (2006.01)

(52) U.S. Cl. ..... 425/149; 425/84; 425/405.1; 425/590; 264/87; 264/328.2; 264/651; 264/667

(58) Field of Classification Search ..... 425/590; 264/328.13, 645, 651, 667
See application file for complete search history.

(56) References Cited

U.S. PATENT DOCUMENTS 4,798,525 A * 1/1989 Sato et al. ..... 425/84
5,380,385 A * 1/1995 Derroire et al. ..... 156/149
6,655,942 B1 12/2003 Rivola

FOREIGN PATENT DOCUMENTS

DE 3502348 A1 7/1986
EP 1043132 A2 10/2000
IT 1236072 B 12/1992

* cited by examiner

*Primary Examiner* — Philip Tucker
*Assistant Examiner* — William Bell
(74) *Attorney, Agent, or Firm* — Pearne & Gordon LLP

(57) ABSTRACT

An installation (100) for the manufacture of ceramic products comprises a mold (1) divided into at least two parts (2, 3) forming an internal cavity (C) where the ceramic product is formed, and mobile towards and away from each other, under the action of respective drive means (4) acting in both directions along a predetermined clamping line (S), in such a way as to join or detach the parts (2, 3) to/from each other; each part (2, 3) of the mold (1) comprises at least one rear outside surface (2*p*, 3*p*) and one lateral outside surface (2*s*, 3*s*); at least one of the parts (2, 3) is equipped with means (6) for containing and controlling a fluid and encompassing the rear (2*p*, 3*p*) and lateral (2*s*, 3*s*) outside surfaces of the mold (1) part (2, 3); the containment means (6) are associated with the part (2, 3) of the mold (1) in such a way that during the product casting cycle the forces (SF) acting on the part (2, 3) of the mold (1) are constantly compensated by correlated forces (FR).

29 Claims, 6 Drawing Sheets

INSTALLATION FOR THE MANUFACTURE OF CERAMIC PRODUCTS

BACKGROUND OF THE INVENTION

This invention relates to an installation for the manufacture of ceramic products, in particular for the manufacture of ceramic sanitaryware.

As is well known, ceramic sanitaryware (such as washbasins, toilet bowls, bidets, shower trays and the like) is made by casting a fluid mixture (known as "slip" in the jargon of the trade, consisting of a ceramic body in aqueous suspension) in customary molds with a porous structure, made in particular from resins.

These porous molds are composed of at least two parts (usually known as "male" and "female" in the jargon of the trade) which are joined to form an internal cavity where the ceramic product is formed.

The porous surfaces that form the sides of each cavity will hereinafter be referred to as the inside surfaces of the mold.

Each mold part also comprises a rear outside surface or back, on which the forces necessary to keep the two parts together during the casting cycle are exerted, and a lateral outside surface.

At least one of the two outside surfaces is associated with auxiliary elements designed to support and keep the mold in place within the installation.

There are also contact surfaces which generally act as transitions between the lateral outside surfaces and the closing surfaces.

Internally, these porous molds are provided with a drainage system designed to allow the fluids that go through the inside surfaces to be channeled to the outside, or to pump fluids in under pressure in the opposite direction in order to detach the molded product from the mold walls or to recondition the mold part.

The two or more parts of the mold are mounted in suitable installations (that differ according to the type of product to be cast) and comprising at least the following:

a fixed structure which, through passive connecting means, acts as a support for at least one part of the mold;

drive means for moving and positioning at least one part of the mold at least in order to move the mold parts towards each other (so as to close the mold when casting is in progress) and away from each other to allow the cast piece to be extracted;

clamping means for keeping the mold parts in the correctly closed position, overcoming the forces generated inside the cavity during the casting cycle;

cavity service means such as means for feeding the slip into the mold when the mold parts are clamped shut or for injecting air for consolidating the slip and draining out the excess slip during the casting cycle;

service means for the above mentioned drainage system.

Further, one of the well known characteristics of porous resin molds is their good mechanical strength which allows them to be used for high pressure casting, that is to say, for pumping the slip into the mold and subsequently forming the cast wall thickness at high pressure (usually between 3 and 15 bar).

These pressures inside the mold, however, produce forces in directions normal to the inside surfaces of the mold parts, with the risk of deforming the mold: the directions adopted by the force components are not only the direction in which the mold parts are moved together and clamped shut but also the directions at right angles (and hence transversal) to the mold part clamping direction.

These forces must therefore be opposed by suitable devices in order to "contain" the forces in play.

As regards the forces generated in the mold clamping direction, the above mentioned casting installations may (in one prior art solution) comprises a fixed abutment wall operating on the back of one of the mold parts, and a drive cylinder that operates on a mobile wall which in turn operates on the back of the other part of the mold.

As is also known in the trade, the cylinder may apply on the mobile part of the mold force that is constant or variable instant by instant as a function of slip pressure (known in the jargon of the trade as "proportional clamping"). To this must be added the fact that the relative movements of the mold parts towards each other during the casting cycle may be either free and, hence, determined only by the balance of the forces in play and by the deformability characteristics of the resins, or limited to a maximum value thanks to the presence of mechanical stops which absorb the force applied by the piston in excess of the force sufficient to determine the maximum acceptable deformation (known in the jargon of the trade as "controlled deformation clamping").

As regards the forces generated in directions at right angles to the clamping direction, on the other hand, prior art solutions include purely passive mechanical systems that can preload the resin to varying extents with initial compression stresses along said transversal directions and whose reaction to the forces produced inside the cavity during the casting cycle and tending to compress the mold walls and to deform the lateral outside surface towards the containment device depends only on the rigidity of the containment device itself, or active mechanical systems where the reaction of the containment device is controlled over time and as a function, instant by instant, of slip pressure.

For this purpose, the Applicant has devised and produced a device for "containing" the forces (see also patent EP 1.043.132) where one of the half-parts of the mold comprises a frame that delimits a space, between the frame and the half-part, for housing an element expandable by a fluid from the outside and designed to contain the forces generated by the pressure of the slip inside the mold.

This system regulates the pressure of the fluid inside the expandable element, which is correlated constantly with slip pressure, obtaining an improved reaction, eliminating the potential deformation of the mold which leads to undesirable stress on the part being cast and, hence, to possible defects, and controlling elastic contractions of the mold.

In view of the excellent results obtained by this solution in controlling the components of the forces in the directions at right angles (and hence transversal) to the mold part clamping direction, it would be desirable to also be able to control the force in the clamping direction more effectively than has been possible up to now.

At present, the solution involving a proportional force of the clamping cylinder is calibrated in such a way as to apply to all the parts of the mold the same pressure as that applied by the slip.

The crux of the matter, however, is that the hydraulic system, which acts on a flat part which is rigid by its very nature is a system with limited opposing precision, that is to say, with relatively wide tolerances compared to the requirements of the mold and with a considerably lower precision than that of the fluid system for the other components, which adapts the movements of the abutment surface opposing the lateral outside surface of the mold to the compressibility requirements of the resin layer below.

SUMMARY OF THE INVENTION

This invention therefore has for an aim to provide an installation where the mold is subjected to a precisely determined pressure at all points of its outside surface and always correlated with the pressure inside the mold during the casting cycle.

Accordingly, this invention achieves this aim by providing an installation for the manufacture of ceramic products, in particular for the manufacture of ceramic sanitaryware and comprising the technical characteristics set out in one or more of the appended claims.

BRIEF DESCRIPTION OF THE DRAWINGS

The technical characteristics of the invention, with reference to the above aims, are clearly described in the appended claims and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
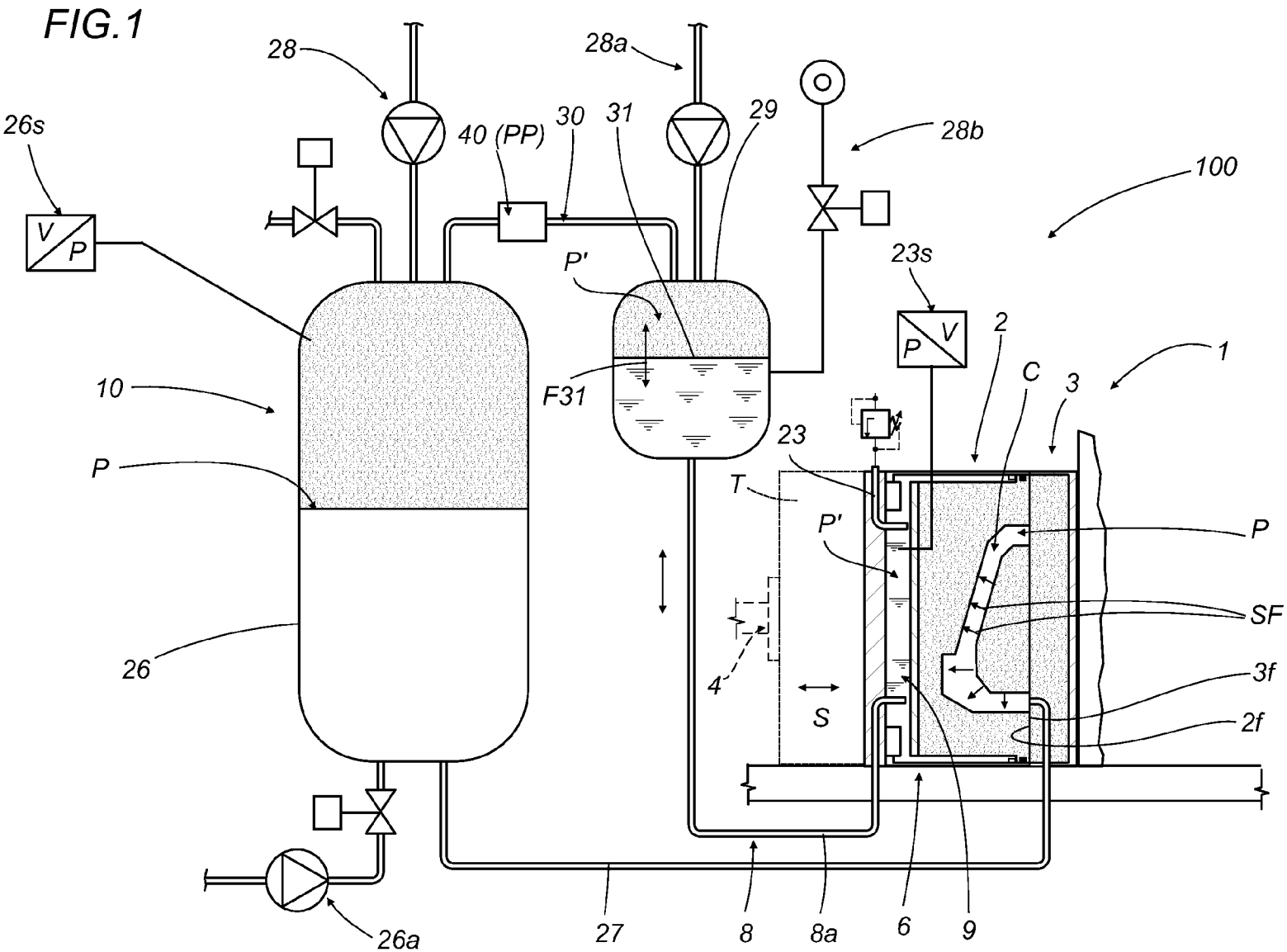
FIG. 1 is a schematic side view, with some parts in cross section and others cut away to better illustrate others, of a first embodiment of the ceramic manufacturing installation according to the present invention.
Figure 2:
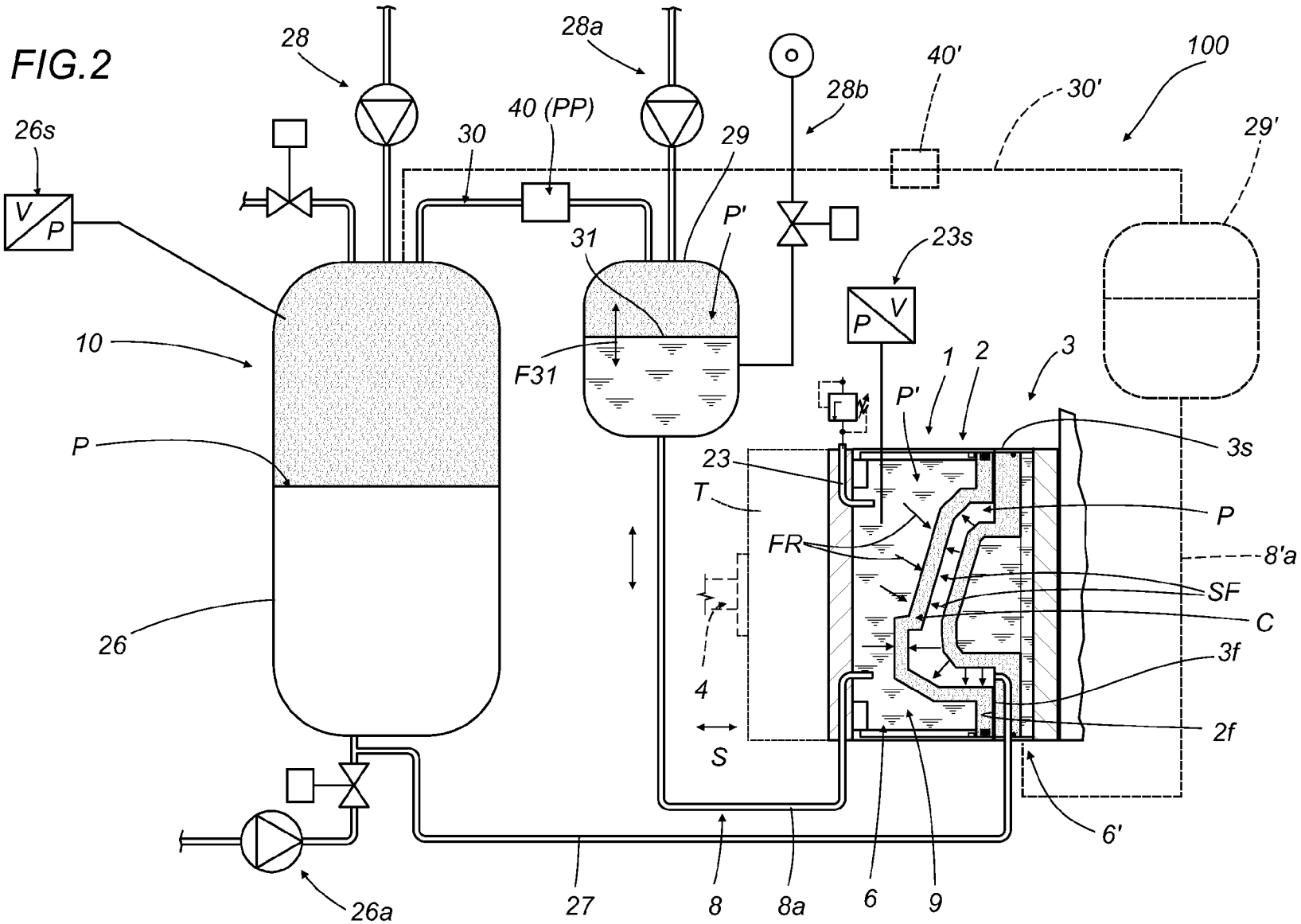
FIG. 2 is a schematic side view, with some parts in cross section and others cut away to better illustrate others, of a second embodiment of the ceramic manufacturing installation according to the invention.

With reference to the accompanying drawings, in particular FIGS. 1 and 2, the installation according to the invention is used for manufacturing ceramic products, in particular but not limited to, ceramic sanitaryware (such as, for example, washbasins, toilet bowls, bidets, shower trays, and the like).

This installation, labeled 100 in its entirety, comprises a mold 1 divided into at least two parts 2 and 3, forming an internal cavity C where the ceramic product is formed.

Each part 2 and 3 of the mold 1 is briefly described below in order to give a clear overview of the invention.

Figure 6:
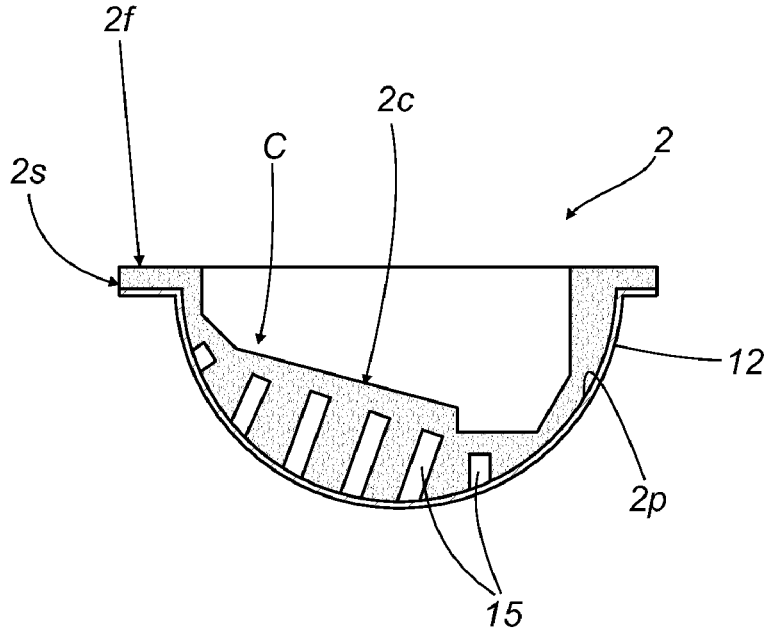
FIG. 6 is a schematic side view, with some parts in cross section, of the porous resin part of a part of a shell mold, with the respective sealed covering element, used in the installation according to the invention.
Figure 7:
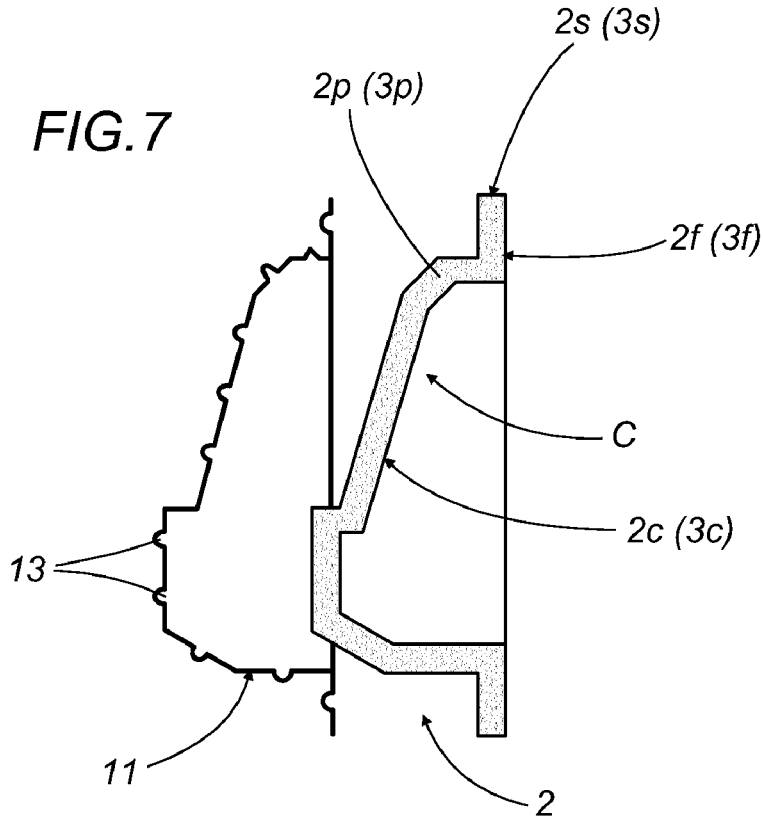
FIG. 7 is a schematic exploded side view of a part of a half mold used in the installation according to the invention, and shows, in particular, the porous resin portion and a sealed covering element.

Basically, each part 2 and 3 of the mold 1 is composed of a body delimited by: an outside surface comprising a rear surface 2*p* and 3*p* and a lateral surface 2*s* and 3*s*, and a working surface comprising an inside surface 2*c* and 3*c* wet by a casting liquid and defining the cavity C, and a front contact surface 2*f* and 3*f* which abuts the respective contact surface 3*f* and 2*f* of the other part 3 and 2 of the mold 1 when the two parts 3 and 2 of the mold 1 are closed (for the respective references, see also FIGS. 6 and 7).

The body delimited by these surfaces is mostly composed, by way of non-limiting example, by one or more volumes of permeable or porous materials stably connected to each other.

The two parts 2 and 3 can move towards and away from each other, under the action of respective drive means 4 acting in both directions along a predetermined clamping line S (see arrows in FIGS. 1 and 2), in such a way as to join or detach the two parts 2 and 3 to/from each other.

When the two parts 2 and 3 are closed, the product casting liquid (slip in the case of ceramic products) is fed into the cavity C in order to cast the product.

The feeding of the liquid (and also of other fluids, as will become clearer as this description continues) is accomplished by respective first feed means 10 at pressures P that differ according to the product casting cycle (the first feed means 10 being described in more detail below).

In the embodiment of the installation 100 illustrated, the drive means 4 are in the form of a cylinder for moving the part 2 which is in turn supported by a crossbar T, but this embodiment must be considered as a non-limiting example of how to implement the invention, since the means 4 may be embodied by other floor or overhead rail or guide systems for both single-mold and multiple mold installations, without thereby departing from the scope of the invention.

As also shown in FIGS. 1 and 2, at least one of the parts—the one labeled 2 in this non-limiting example—is equipped with means 6 for containing a fluid and encompassing at least the above mentioned rear and lateral outside surfaces 2*p* and 2*s* of the mold 1 part 2 itself; these containment means 6 are associated with the part 2 in such a way that during the product casting cycle the fluid constantly applies reaction forces FR to compensate the forces SF acting on the part 2 of the mold 1, in the directions defined by the shape of the inside surface 2*c* of the mold part 2.

In the embodiment illustrated, again by way of example, these containment and control means 6 are interposed, in use, between the mold part 2 and the drive means 4.

FIG. 2 also shows that the other mold part 3 may also be equipped with containment and control means 6' acting on the rear and lateral outside surfaces 3*p* and 3*s* of the mold part 3.

For simplicity of description, reference is hereinafter made only to the containment means 6 of only one of the mold parts since the structure is substantially the same for the other part of the mold, too.

In the configuration illustrated here, the part of the mold labeled 2, known in the jargon of the trade as the female part, will be considered.

Looking in more detail (see also FIGS. 3 to 5), the containment and control means 6 comprise a sealed containment element 7 associated with the mold part 2 and surrounding the rear outside surface 2*p* and the lateral outside surface 2*s* of the mold part 2 itself.

The containment element 7 is equipped with means 8 for pumping compensation fluid in and out of at least one compensation chamber 9 defined between the containment element 7 itself and the rear and lateral outside surfaces 2*p* and 2*s* of the mold part 2.

In particular, the means 8 for pumping compensation fluid in and out of the compensation chamber 9 are correlated with the aforementioned means 10 for controlling the fluids in the cavity C: thus, in the chamber 9, the pressures P present in the molding cavity C can be compensated in real time with a suitable pressure P' in the compensation chamber 9.

It follows that the forces SF acting on the mold part 2 along the aforementioned directions normal to the surface 2*c* of the mold part 2 are, so to speak, proportionally balanced by reaction forces FR.

At least the outside surface 2*p* of the mold part 2 has a protective jacket 11 or 12 (that might be, without limiting the invention, of the laminated type), sealed and shaped to match the profile of the rear outside surface 2*p* of the part 2 (see also FIG. 7) and creating a separating surface between the compensation chamber 9 and the rear outside surface 2*p* itself, or the thickness of the permeable material constituting the body of the mold part 2.

This structural combination makes it possible to choose from different structural solutions, meaning geometrical shapes, of the mold part contained within the compensation chamber 9, without affecting the quality of the end product.

By way of non-limiting example, the shape of the mold part 2 shown in FIG. 1 has large, geometrically regular outside surfaces, while in FIGS. 2 to 5 and 7, the shape of the part 2 of the mold 1 has geometrically complex outside surfaces, where the profile of the rear outside surface 2*p* and the profile of the working surface 2*c*-2*f*, joined by the lateral transition surface 2*s* (in practice the edge), are substantially parallel.

In the second situation, the mold part is like a "carving" in space, with the material making up the body, that is, the substantially active and permeable part of the mold part, having a reduced thickness.

This architecture offers considerable advantages, such as, for example, a lighter overall weight of the system and hence mold movement systems that are more economical.

Another advantage is that the thinner the resin layer is in the thrust direction in which the forces are applied to the inside surface during the casting cycle, the lesser the effects of its compressibility on the cast product.

Obviously, as mentioned previously, each rear outside surface 2*p* in these two different embodiments has a matchingly shaped, sealed protective jacket 11 creating a separating surface between the compensation chamber 9 and the rear outside surface 2*p*.

Figure 8:
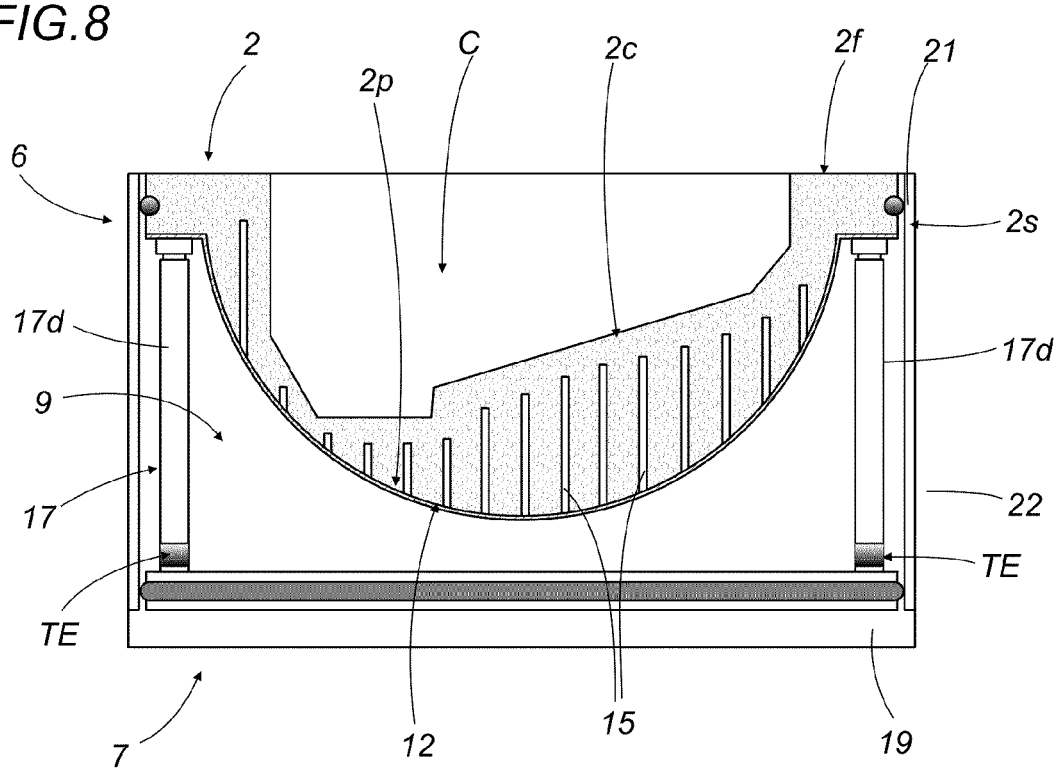
FIG. 8 is a side view, with some parts cut away and others in cross section, of the mold part of FIG. 6 but equipped with a different embodiment of the positioning elements from those of FIG. 5.

FIGS. 6 and 8 illustrate another embodiment of the body of the mold part 2, where the rear outside surface 2*p* of the part 2 of the mold 1 has a standard geometrical profile which, in this particular case, is rounded or shell-like, irrespective of the shape of the surface 2*c* wet by the slip.

In this case too, the rear outside surface 2*p* of the "shell" has a matchingly shaped protective jacket 12 for separating the compensation chamber 9 from the rear outside surface 2*p*.

In this embodiment, the main advantage is, precisely, the possibility of normalizing the mold structure independently of the shape of the cavity C, allowing the processes for manufacturing the jackets and auxiliary equipment to be standardized and thus significantly reducing overall costs.

The jacket 11 or 12 is preferably made of a composite material (such as glass fiber or carbon fiber) in order to improve the mechanical strength of the mold body, which is subjected to both internal and external pressures, particularly in the case of the last two geometrical configurations described above where the layer of permeable resin has a reduced thickness.

Figure 5:
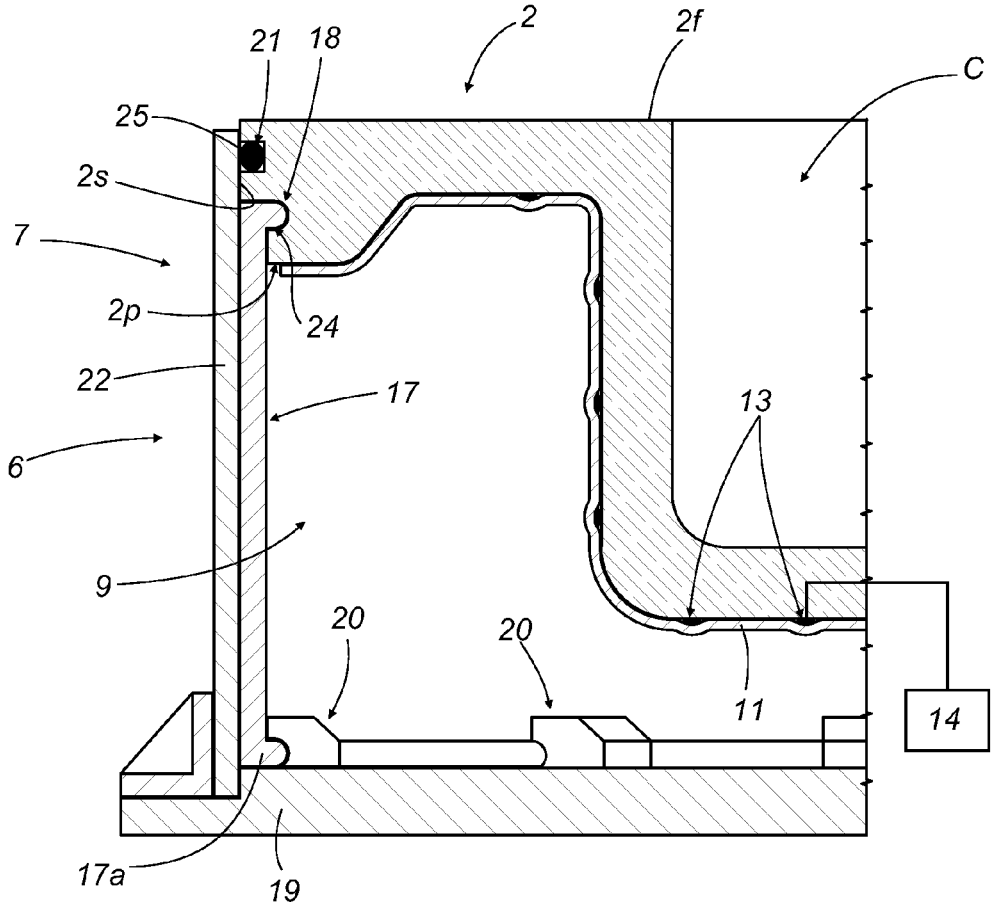
FIG. 5 illustrates the half mold of FIGS. 3 and 4 in a partial planar section.

In view of the particular structural combination between the rear outside surface 2*p* and the jacket 11 or 12, means 13, 15 may also be provided for draining out some of the product casting liquid and interposed between the jacket 11 or 12 and the mold part 2 or made directly in the mold part 2, said means being connected to an external service unit 14 of the aforementioned drainage system (illustrated as a block in FIG. 5, since it is of known type).

To this must be added the fact that precisely because there are drainage channels between the rear outside surface 2*p* and the jacket 11 or 12, adhesion means (for example a suitable adhesive) are provided between them to hold them together and oppose the pushing forces created when the unit 14 pumps fluids into the drainage system under pressure (for example when cleaning/rinsing the mold).

A closer look at the compensation chamber 9 reveals that the latter comprises the aforementioned containment element 7 which in turn comprises at least the following (see FIGS. 3, 4 and 5):

a rigid element 22 defining the walls of the compensation chamber 9;

a base plate 19 associated with the rigid element 22;

sealing means 21 acting between the rigid element 22 and the mold part 2.

Besides these components, there is also a positioning element or spacer 17 associated with the lateral outside surface 2*s* of the part 2, through respective first fastening means 18, and designed to position the mold part 2 relative to the base plate 19; the rigid element 22 is placed over the spacer 17.

Through second fastening means 20, the spacer 17 can also be associated with the base plate 19 of the compensation chamber 9.

More specifically, the sealing means 21 are positioned and active between the lateral outside surface 2*s* of the mold part 2 and the rigid element 22.

As shown in FIGS. 1 and 2, the base plate 19 may (in one non-limiting example embodiment) be equipped with an opening leading into the chamber 9 and occupied by a second conduit 8*a* (there is also a first conduit 27, described below, forming part of the installation 100) for the passage of fluid and forming part of the aforementioned means 8 for pumping fluid in and out of the sealed compensation chamber 9.

Obviously, the second conduit 8*a* may be placed in communication with the compensation chamber 9 through an opening made in the element 22.

The plate 19 may also be provided with a second opening occupied by a third safety relief conduit 23 leading to a maximum pressure valve for the sealed compensation chamber 9.

Obviously, the third conduit 23 may also be connected to the compensation chamber 9 through the element 22 by way of a suitable opening.

In the case illustrated, the base plate 19 is connected to the means 4 that move the half-mold 2 (through the aforementioned crossbar T) acting in both directions along a predetermined clamping line S in such a way as to join or detach the two parts 2, 3 to/from each other.

As regards the possible mechanical solutions present, the above mentioned first fastening means may be in the form of a first enlarged end edge 18 made on the spacer 17 and engageable with a matching first slot 24 formed on the lateral outside surface 2*s* of the part 2.

Figure 4:
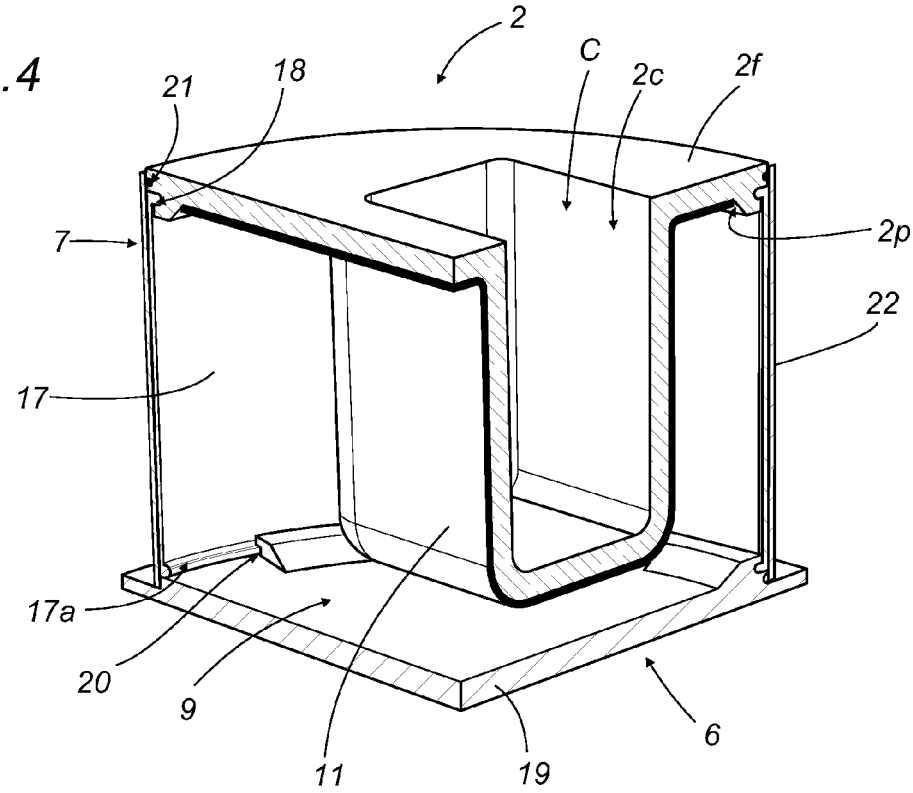
FIG. 4 is a perspective view partially in cross section illustrating the assembled half mold of FIG. 3.

The above mentioned second fastening means may be in the form of a plurality of brackets 20 located on the base plate 19 and engageable with a second enlarged end edge 17*a* of the spacer 17 (see FIGS. 4 and 5).

The sealing means may comprise a gasket or seal 21 (in this case, for example, a ring seal) made of incompressible material housed in a matching second slot 25 in the mold part 2 and retained, on the opposite side, by the aforementioned rigid, reinforcing element 22.

Figure 3:
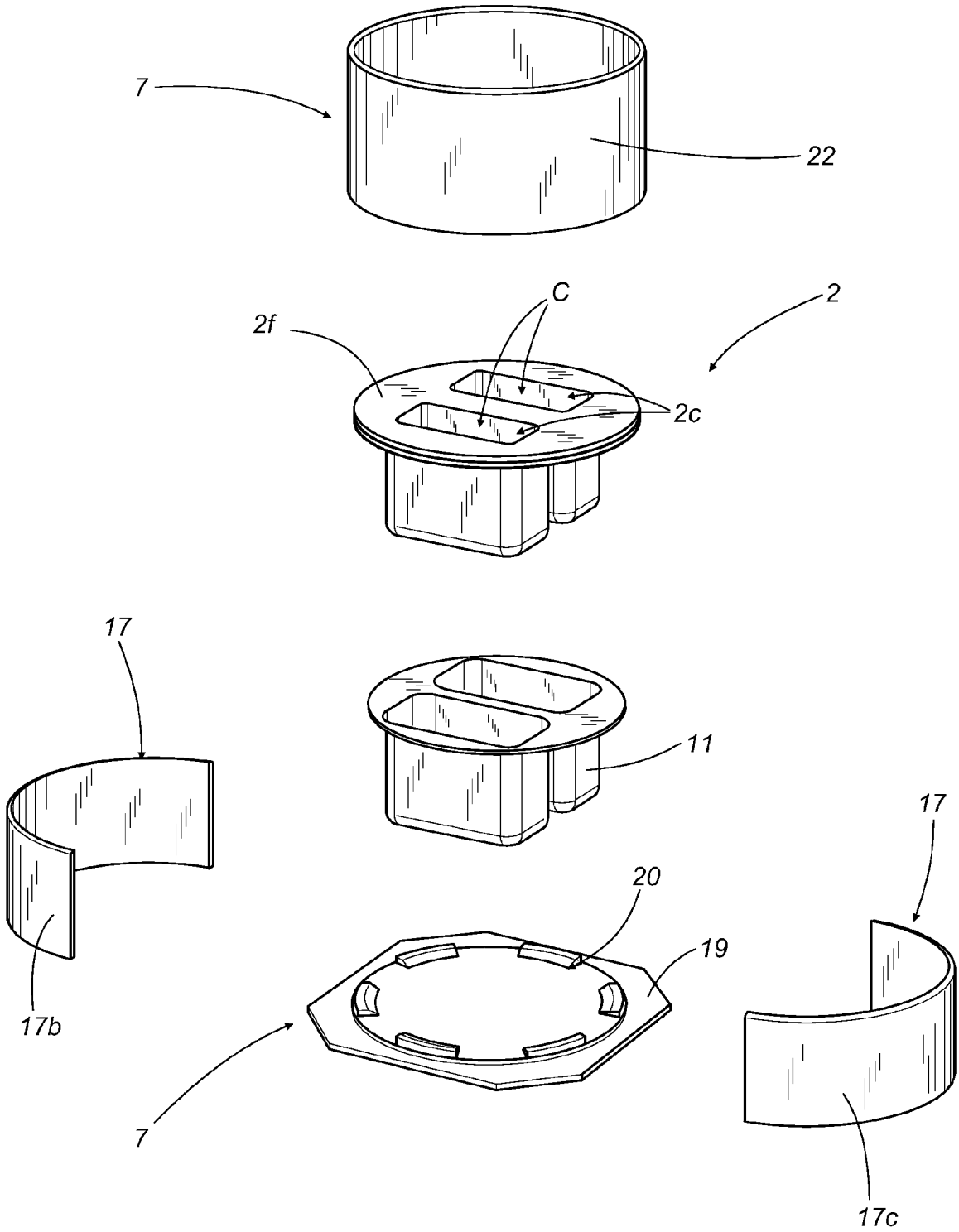
FIG. 3 is an exploded perspective view of a half mold used for the manufacture of ceramic products and applicable to the installation according to the invention.

FIGS. 3 and 4 illustrate an example of a female mold part 2 where the spacer 17 is divided into at least two half-parts 17*b*, 17*c* which, in use, can be joined to each other on the part 2 and which can be associated with both the part 2 and the base plate 19 through the first fastening means 18 and the second fastening means 20.

An alternative embodiment of the structure described above is shown in FIGS. 6, 8 and 9.

In this embodiment, the mold part 2 is of the rounded or shell type, equipped with the above mentioned jacket 12 to cover the rear outside surface 2*p* and having a circular flange connecting it to the lateral outside surface 2*s*.

In FIG. 8, the basic elements of the structure of the containment element 7 are the same as those of the previous embodiment except for the positioning element 17 which, in this case, comprises two or more columns or pillars 17*d* each associated at one end to the base plate 19 and at the other end to the flanged zone of the rear outside surface 2*p*.

The pillars 17*d* may be equipped with elastic blocks TE for joining the flange to the bottom in such a way as to obtain elastic compliance providing defined structural rigidity during the different operating steps, in particular, through axial absorption of the pillars 17*d*.

Figure 9:
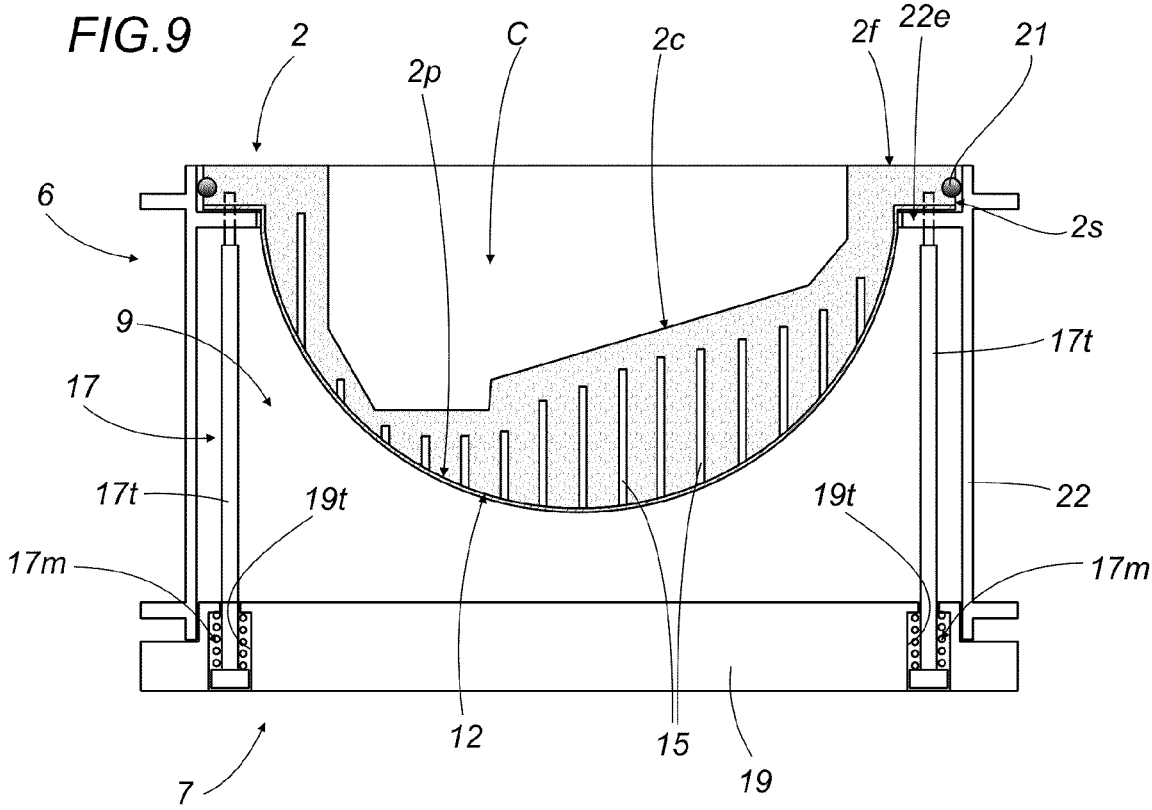
FIG. 9 is a side view, with some parts cut away and others in cross section, again of the mold part of FIG. 6 but equipped with yet another different embodiment of the positioning elements.

Yet another embodiment is illustrated in FIG. 9, where the positioning element 17 is in the form of two or more tie rods 17*t* each associated at one end to the base plate 19 and at the other end to the flanged zone of the rear outside surface 2*p*.

The end of each tie rod 17*t* is inserted in a respective seat 19*t* in the base plate 19, with a spring 17*m* fitted round it, the spring being retained at one end by the end head of the respective tie rod 17*t* and at the other end by the upper inside wall of the seat 19*t*.

The load of the spring 17*m*, in a non-working situation, keeps the mold part 2 and the base plate 19 closer together (minimum gap predetermined also thanks to a limit stop tooth 22*e* located along the inside surface of the element 22), while the gap widens at the beginning of the operating cycle on account of the increased pressure inside the chamber 9 and, hence, the pushing force exerted by the fluid on the rear outside surface 2*p*, which gradually overcomes the pulling force of the spring 17*m*.

All the positioning element embodiments described up to now allow adaptable, safe contact between the working surfaces of the two parts 2 and 3 of the mold 1.

It follows that with a mold 1 structured in this way, even the rest of the ceramic casting installation 100 must be equipped with components in addition to the traditional ones such as the aforementioned means 10 for controlling the service fluids in the cavity C (ceramic casting liquid and air for draining out the excess liquid/consolidating the product).

Suffice it to say that the pressure P of the casting liquid or slip and of the air assumes values that vary as a function of time (P=P(t)) during the casting cycle, and the counter-thrust pressure P' of the compensation fluid is a linear function of the pressure inside the cavity C, and therefore even $P'=P'(t)=K_1+K_2*P(t)$.

These values are controlled by respective sensors 26*s* and 23*s* located, in the case of the casting liquid/air, in a first liquid containment and pressurization tank 26 and, in the case of the compensation fluid, inside the compensation chamber 9 (see FIGS. 1 and 2).

Returning now to FIGS. 1 and 2, the first liquid/air feed means 10 may comprise:

the first casting liquid tank 26 connected by a first conduit 27 to the molding cavity C; and adjustable means 28 for introducing a gaseous fluid into the first tank 26 in such a way as to pressurize the first tank 26 and thus force the liquid into the cavity C at pressures P which are predetermined as a function of the product casting cycle.

The casting liquid is fed into the tank 26 by suitable feed means 26*a*.

In addition to these components, there is a second tank 29 containing the aforementioned compensation fluid that can be fed into the compensation chamber 9 through the aforementioned second conduit 8*a*.

The second tank 29 (equipped with respective independent adjustable means 28*a* for introducing the gaseous fluid and means 28*b* for supplying the compensation fluid) is connected through a fourth conduit 30 to the first tank 26 at the zone subjected to the thrust of the pressurized gaseous fluid in such a way as to enable the pressure P' present in the second tank 29 to be equalized with the pressure P present in the first tank 26, that is to say, to correlate the counter-thrust pressure of the compensation fluid in the chamber 9 with the thrust pressure that forces the liquid/air into the casting cavity C.

Obviously, as we shall see later, the correlation between the pressure in the cavity C and the pressure of the compensation fluid is maintained also during the decompression, draining off and consolidation steps thanks to the presence of the sensors 23*s* and 26*s* and of the respective fluid feed means 28 and 28*a* of the first and the second tank 26 and 29.

The numerals 40 and 40' in FIGS. 1 and 2 denote blocks, located on fourth conduits 30 and 30', representing generic control means for correctly correlating the two pressures P and P', while supporting the possibility of initially preloading the chamber or chambers 9, 9' with compensation fluid PP before the casting cycle starts, that is to say, before the casting liquid starts flowing in.

To enable the compensation fluid to flow in and out correctly without mixing with the gaseous fluid, the second tank 29 may be equipped with a partition membrane 31 keeping the gaseous fluid separate from the compensation fluid.

The membrane 31 may be of the elastic type and mobile in both directions along the second tank 29 (see arrows F31).

As regards the compensation fluid, this may be a liquid and, more specifically, without limiting the invention, water, while the pressurizing gaseous fluid is air.

The dashed lines in FIG. 2 indicate the elements that may be present on the other part 3 of the mold, that is to say, a third compensation fluid tank 29', identical to the second tank 29, and equipped with a conduit 8'*a* for connecting a compensation chamber 9' and also connected to the first tank 26 by way of another conduit 30'.

With an installation 100 structured in this way, a method for manufacturing a ceramic product may comprise at least the following steps:

a) moving the two parts 2 and 3 closer together and clamping them shut, through the drive means 4, with a predetermined clamping force F and causing the rigid element 22 to come into contact with the corresponding rigid element of the mold part 3;

b) preloading the chamber 9 to a defined pressure PP by feeding fluid into it;

c) filling the cavity C with casting liquid at a pressure P(t) and further pressurizing the compensation chamber 9 with the respective fluid at the correlated pressure P' (t) (being the preloading pressure PP plus the pressure KP(t));

d) pressurizing the casting liquid in the cavity C to a pressure P(t) and correspondingly pressurizing the compensation fluid in the chamber 9 to a pressure P'(t), in order to form the thickness of the product by also draining off part of the liquid (water) through the aforementioned draining channels 13 or 15;

e) decompressing the cavity C, and hence the casting liquid still present in it, to a predetermined pressure P and correspondingly decompressing the fluid in the compensation chamber 9 to the pressure P';

f) completely emptying the used slip out of the cavity C until reaching the minimum pressure and correspondingly decompressing the compensation chamber 9;

g) consolidating the ceramic product in air at a pressure P(t) and consequently bringing the pressure in the compensation chamber 9 up to P'(t);

h) decompressing the cast product to P=0 and consequently returning P' to PP;

i) opening the two parts 2 and 3, again through the drive means 4, and extracting the cast product from the portion of the cavity C of the first mold part which is thus detached from the cast product;

j) resetting P' and extracting the cast product from the second mold part, which is detached from the product.

This method, which regards the basic steps in the casting of a ceramic product, makes it possible, thanks to the reaction forces exerted on the outside surface of the mold, to control the forces acting on the inside surface: not only in the directions at right angles (and hence transversal) to the clamping line S, but also in the directions parallel to the clamping line S and the respective components derived from the rear outside surface 2*p* of the mold part.

Thus, the installation structured in this way fully achieves the above mentioned aims thanks to the overall control of the forces inside the mold by a fluid which compensates these forces in modulated manner at all stages of the casting process and in all dimensions of the mold.

This modulated control improves reaction on the mold and eliminates potential deformation of the mold, thereby preventing elastic contractions that could have negative effects on the quality of the product being cast.

The invention described above is susceptible of industrial application and may be modified and adapted in several ways without thereby departing from the scope of the inventive concept. Moreover, all the details of the invention may be substituted by technically equivalent elements.

What is claimed is:

1. An installation for the manufacture of ceramic products, the installation (100) comprising at least one mold (1) divided into at least two parts (2, 3) forming an internal cavity (C) where the ceramic product is formed, and mobile towards and away from each other, under the action of respective drive means (4) acting in both directions along a predetermined clamping line (S), in such a way as to join or detach the parts (2, 3) to/from each other; each part (2, 3) of the mold (1) comprising at least one rear outside surface (2*p*, 3*p*) and one lateral outside surface (2*s*, 3*s*); wherein at least one of the parts (2, 3) of the mold (1) is equipped with means (6) for containing and controlling a fluid, encompassing at least the rear outside surface (2*p*, 3*p*) and the lateral outside surface (2*s*, 3*s*) of the mold (1) part (2, 3) and being associated with the part (2, 3) of the mold (1) in such a way that during the product casting cycle the forces (SF) acting on the part (2, 3) of the mold (1) are constantly compensated, wherein said containment and control means (6) comprise a hermetically sealed containment element (7) associated with the mold part (2, 3) to surround the rear outside surface (2*p*, 3*p*) and the lateral outside surface (2*s*, 3*s*) of the mold part (2, 3); said containment element (7) being equipped with means (8) for pumping compensation fluid in and out of a compensation chamber (9) defined between the containment element (7) itself and the rear (2*p*, 3*p*) and lateral (2*s*, 3*s*) outside surfaces of the mold part (2, 3), wherein the containment element (7) comprises at least;

a rigid element (22) defining the walls of the compensation chamber (9);

a base plate (19) associated with the rigid element (22);

sealing means (21) acting at least between the rigid element (22) and the mold part (2, 3);

a positioning or spacing element (17), located inside the rigid element (22) and associated bilaterally with the lateral outside surface (2*s*, 3*s*) of the mold part (2, 3) and to the base plate (19), through respective first and second fastening means (18, 20), said element (17) being designed to position the mold part (2, 3) relative to the base plate (19), wherein the base plate (19) is connected to means (4) for moving the mold part (2, 3) and acting in both directions along a predetermined clamping line (S) in such a way as to join or detach the two parts (2, 3) to/from each other.

2. The installation according to claim 1, wherein one other part (3, 2) of the mold (1) is also equipped with containment and control means (6') encompassing the rear outside surface (3*p*, 2*p*) and the lateral outside surface (3*s*, 2*s*) of said one other part (3, 2) of the mold (1).

3. The installation according to claim 1, wherein the containment and control means (6) are positioned and active on the rear outside surface (2*p*, 3*p*) and on the lateral outside surface (2*s*, 3*s*) of the mold part (2, 3) and, in use, are interposed between said part (2, 3) and the drive means (4).

4. The installation according to claim 1, where a molding cavity (C), defined by inside surfaces (2*c*, 3*c*) of the part (2, 3) wet by a casting liquid, can be supplied with said product casting liquid through respective first means (10) for controlling the service fluids in the cavity (C) at different pressures (P) according to the different steps in the product casting cycle, the installation being wherein the means (8) for pumping containment and control compensation fluid in and out of the compensation chamber (9) are correlated with the first means (10) for controlling the service fluids, so that, in the chamber (9), the pressures (P) in the molding cavity (C) can be compensated in real time with a suitable pressure (P') in the compensation chamber (9).

5. The installation according to claim 1, wherein at least the rear outside surface (2*p*, 3*p*) of the part (2, 3) of the mold (1) has a protective jacket (11), sealed and shaped to match the profile of the rear outside surface (2*p*, 3*p*) of the part (2, 3) and creating a separating surface between the compensation chamber (9) and the rear outside surface (2*p*, 3*p*) of said part (2, 3).

6. The installation according to claim 1, where each of the parts (2, 3) of the mold (1) is delimited by: an outside surface comprising the rear surface (2*p*, 3*p*) and the lateral surface (2*s*, 3*s*), and a working surface comprising an inside surface (2*c*, 3*c*), wet by a casting liquid and defining the cavity (C), and a front contact surface (2*f*, 3*f*) which abuts the respective contact surface (3*f*, 2*f*) of another mold part (3, 2) when the two mold parts (3, 2) are closed, the installation being wherein the part (2, 3) of the mold (1) has geometrically complex surfaces, where the profile at least of the rear outside surface (2*p*, 3*p*) and the profile of the working surface or portion (2*c*, 3*c*-2*f*, 3*f*), joined by a lateral transition surface (2*s*, 3*s*), are substantially parallel, so as to obtain a mold part that is like a "carving" in space; at least the rear outside surface (2*p*, 3*p*) being provided with a matching, sealed protective jacket (11) creating a surface to separate the compensation chamber (9) from the rear outside surface (2*p*, 3*p*).

7. The installation according to claim 6, further comprising means (13, 15) for draining out some of the product casting liquid and interposed between the jacket (11, 12) and the mold part (2, 3) and connected to an external service unit (14) of the drainage system.

8. The installation according to claim 6, further comprising, between the rear outside surface (2*p*, 3*p*) and the jacket (11, 12), adhesion means to hold them together and oppose the pushing forces created when the external service unit (14) of the drainage system pumps fluids into the drainage means (13, 15) under pressure.

9. The installation according to claim 6, wherein the jacket (11, 12) is made of a composite material in order to improve the mechanical strength of the part (2, 3) of the mold (1) which is subjected to unwanted pressure imbalances from both the inside, that is, the inside surfaces (2*c*, 3*c*), and the outside of the mold (1), that is, the outside surfaces (2*p*, 3*p*; 2*s*, 3*s*).

10. The installation according to claim 1, where each of the parts (2, 3) of the mold (1) is delimited by: an outside surface comprising the rear surface (2*p*, 3*p*) and the lateral surface (2*s*, 3*s*), and a working surface comprising an inside surface (2*c*, 3*c*), wet by a casting liquid and defining the cavity (C), and a front contact surface (2*f*, 3*f*) which abuts the respective contact surface (3*f*, 2*f*) of another mold part (3, 2) when the two mold parts (3, 2) are closed, the installation being wherein the rear outside surface of the part (2, 3) of the mold (1) has a profile with a geometrically standardized shape, defined by the thickness of the material the mole part is made of, irrespective of the shape of the cavity (C); the rear outside surface (2*p*, 3*p*) being provided with a matching, sealed protective jacket (12) creating a surface to separate the compensation chamber (9) from the rear outside surface (2*p*, 3*p*).

11. The installation according to claim 10, wherein the rear outside surface of the part (2, 3) of the mold (1) has a rounded or shell-like profile, defined by the thickness of the material the mold part is made of; the rear outside surface (2*p*, 3*p*) being provided with a matching, shell-like sealed protective jacket (12) creating a surface to separate the compensation chamber (9) from the rear outside surface (2*p*, 3*p*).

12. The installation according to claim 1, wherein the base plate (19) is provided with an opening occupied by a second conduit (8*a*) for the passage of fluid and forming part of the means (8) for pumping fluid in and out of the sealed compensation chamber (9).

13. The installation according to claim 1, wherein the rigid element (22) is provided with an opening occupied by a second conduit (8*a*) for the passage of fluid and forming part of the means (8) for pumping fluid in and out of the sealed compensation chamber (9).

14. The installation according to claim 1, wherein the plate (19) is provided with a second opening occupied by a third safety relief conduit (23) leading to a maximum pressure safety valve for the sealed compensation chamber (9).

15. The installation according to claim 1, wherein the rigid element (22) is provided with a second opening occupied by a third safety relief conduit (23) leading to a maximum pressure safety valve for the sealed compensation chamber (9).

16. The installation according to claim 1, wherein the second fastening means are in the form of a plurality of brackets (20) located on the base plate (19) and engageable with a second enlarged end edge (17*a*) of the positioning element or spacer (17).

17. The installation according to claim 1, wherein the first fastening means comprise a first enlarged end edge (18) made on the positioning element or spacer (17) and engageable with a matching first slot (24) formed on the lateral outside surface (2*s*, 3*s*) of the mold part (2, 3).

18. The installation according to claim 1, wherein the sealing means comprise a gasket or seal (21) made of incompressible material housed in a matching second slot (25) in the mold part (2, 3) and retained, on the opposite side, by the rigid element (22).

19. The installation according to claim 1, wherein the positioning element or spacer (17) is divided into at least two half-parts (17*b*, 17*c*) which, in use, can be joined to each other on the mold part (2, 3) and which can be associated with the base plate (19) through the second fastening means (20).

20. The installation according to claim 1, wherein the positioning element (17) is in the form of a plurality of columns or pillars (17*d*) each associated at one end to the base plate (19) and at the other end to the rear outside surface (2*p*);

said pillars (17*d*) being provided with elastic blocks for conferring elastic compliance that provides defined structural rigidity during the different steps of the casting cycle.

21. The installation according to claim 1, wherein the positioning element (17) is in the form of a plurality of tie rods (17*t*) each associated at one end to the base plate (19) and at the other end to the rear outside surface (2*p*); one end of each tie rod (17*t*) being inserted in a respective seat (19*t*) in the base plate (19); the said end of each of the tie rods (17*t*) having a spring (17*m*) fitted round it, the spring being retained at one end by the end head of the respective tie rod (17*t*) and at the other end by the upper inside wall of the seat (19*t*) so that, when not working, the mold part (2, 3) and the base plate (19) are kept closer together.

22. The installation according to claim 1, further comprising a first means (10) for controlling the product casting liquid, said first means (10) for controlling the product casting liquid comprising:

a first casting liquid tank (26) connected by a first conduit (27) to the molding cavity (C), and adjustable means (28) for introducing a gaseous fluid into the first tank (26) in such a way as to pressurize the casting liquid in the cavity at pressures (P) which are predetermined as a function of the product casting cycle, the installation further comprising at least one second tank (29) containing the compensation fluid that can be fed into the compensation chamber (9) through a second conduit (8*a*).

23. The installation according to claim 22, wherein the second tank (29) is connected through a fourth conduit (30) to the first tank (26) at the zone subjected to the thrust of the gaseous fluid in such a way as to enable the pressure (P) present in the first tank (26) to be equalized with the pressure (P') present in the second tank (29), that is to say, to correlate the counter-thrust pressure of the compensation fluid in the chamber (9) with the thrust pressure that forces the liquid/air into the molding cavity (C).

24. The installation according to claim 22, wherein the second tank (29) is equipped with a partition membrane (31) keeping the gaseous fluid separate from the compensation fluid.

25. The installation according to claim 24, wherein the membrane (31) is of the elastic type and mobile along the second tank (29).

26. The installation according to claim 22, wherein the compensation fluid is a liquid.

27. The installation according to claim 22, wherein the compensation fluid is a liquid.

28. The installation according to claim 22, wherein the gaseous thrust fluid is air.

29. The installation according to claim 22, wherein the compensation fluid is water.

* * * * *

UNITED STATES PATENT AND TRADEMARK OFFICE

CERTIFICATE OF CORRECTION

PATENT NO. : 8,057,208 B2
APPLICATION NO. : 12/403818
DATED : November 15, 2011
INVENTOR(S) : Domenico Bambi et al.

It is certified that error appears in the above-identified patent and that said Letters Patent is hereby corrected as shown below:

At column 11, line 29, being line 11 of claim 10, after "the" and before "part" please delete "mole" and insert therefor --mold--.

Signed and Sealed this
Fourteenth Day of February, 2012

David J. Kappos

David J. Kappos
*Director of the United States Patent and Trademark Office*